US012022903B2

(12) United States Patent
Kerr

(10) Patent No.: US 12,022,903 B2
(45) Date of Patent: Jul. 2, 2024

(54) TOOL FOR REMOVING ADHESIVE FROM HAIR EXTENSION WEFT

(71) Applicant: Ceven with a C, LLC, Houston, TX (US)

(72) Inventor: Cecilia Kerr, Houston, TX (US)

(73) Assignee: Ceven with a C, LLC, Houston, TX (US)

( * ) Notice: Subject to any disclaimer, the term of this patent is extended or adjusted under 35 U.S.C. 154(b) by 1 day.

(21) Appl. No.: 15/734,823

(22) PCT Filed: Apr. 4, 2019

(86) PCT No.: PCT/US2019/025800
§ 371 (c)(1),
(2) Date: Dec. 3, 2020

(87) PCT Pub. No.: WO2019/236183
PCT Pub. Date: Dec. 12, 2019

(65) Prior Publication Data

US 2021/0227911 A1 Jul. 29, 2021

Related U.S. Application Data

(60) Provisional application No. 62/680,167, filed on Jun. 4, 2018.

(51) Int. Cl.
*A41G 5/00* (2006.01)

(52) U.S. Cl.
CPC ..... *A41G 5/0086* (2013.01); *A41G 5/008* (2013.01)

(58) Field of Classification Search
CPC .... A41G 5/008; A41G 5/0086; A41G 5/0026; A41G 5/0066; A41G 5/0073; A45D 8/24; A45D 85/20; A45D 85/08; B65D 85/02; B65D 85/08; B08B 11/00; B08B 11/02; B08B 2220/01; A47L 25/00
(Continued)

(56) References Cited

U.S. PATENT DOCUMENTS 1,034,114 A * 7/1912 James ..... E05G 1/024 312/409
3,638,665 A 2/1972 Staffas, Sr.
(Continued)

FOREIGN PATENT DOCUMENTS

DE 102014016904 A1 11/2014

OTHER PUBLICATIONS

International Search Report issued in co-pending PCT Application No. PCT/US/2019/25800, dated Jul. 3, 2019, 6 pages.

*Primary Examiner* — Cris L. Rodriguez
*Assistant Examiner* — Sydney J Pulvidente
(74) *Attorney, Agent, or Firm* — Blank Rome LLP

(57) ABSTRACT

A tool for removing an adhesive from a hair weft includes a base portion having a first region with an interior surface, and a second region; a partial covering portion having a first region with an access aperture exposing the interior surface of the base portion, and a second region; a pivotable hinge coupling the base portion and the partial covering portion and configured to allow the base portion and the partial covering to bias relative to each other; and a containment aperture configured to hold a roll of a fabric therein, the aperture at least partially bounded by the second region of the base portion and the second region of the partial covering portion.

19 Claims, 10 Drawing Sheets

(58) Field of Classification Search
USPC ..... 134/6; 15/209.1–210.1, 220.4
See application file for complete search history.

(56) References Cited

U.S. PATENT DOCUMENTS

| | | | | |
|---|---|---|---|---|
| 3,737,360 | A * | 6/1973 | Horn | B65H 35/0026 206/412 |
| 4,034,891 | A * | 7/1977 | Mecham | B65D 85/67 229/125 |
| 4,753,252 | A | 6/1988 | Boxer | |
| 7,954,921 | B2 | 6/2011 | Ben-Zur et al. | |
| 2008/0041408 | A1 | 2/2008 | Shepherd et al. | |
| 2011/0303241 | A1 * | 12/2011 | Tourigny | B08B 11/00 134/9 |

* cited by examiner

TOOL FOR REMOVING ADHESIVE FROM HAIR EXTENSION WEFT

CROSS-REFERENCE TO RELATED APPLICATIONS

This application is a national stage of International Patent Application No. PCT/2019/25800, filed Apr. 4, 2019, which claims the benefit of U.S. provisional application No. 62/680,167, filed Jun. 4, 2018, the contents of which are incorporated by reference herein in their entirety.

FIELD OF THE INVENTION

The present invention relates to a tools and methods for facilitating the removal of an adhesive from a tape-in natural or synthetic hair weft.

BACKGROUND OF THE INVENTION

A hair weft is an extension of the hair. A hair weft is designed to make one's hair appear thicker or longer. Hair wefts can be made from synthetic, animal, blended and/or human hair. Hair wefts can be straight, wavy, curly or any other suitable style, length or color. Another term often used in place of hair weft is hair curtain. This is due to the curtain-like appearance of the weft itself. Terms such as hair tab or hair strand may also be used in place of hair weft. Unlike many other types of hair extensions, hair wefts are usually long sections of hair that are glued, taped, sewn/braided, anchored with a bead, fused or otherwise attached to one's scalp.

Wefts are typically available in most lengths desired: generally there is no minimum or maximum length of hair wefts. If made from human hair, a hair weft may be cut, straightened, dyed, curled, or treated otherwise as real hair. Some synthetic hair wefts may be treated similarly, though others may break down or yield results other than the ones intended, such as discoloration.

Many people apply hair wefts for use over an extended period of time such as one to three months. Though a hair weft can be intended for long-term use, it can also be attached as a temporary application for events such as a component party costumes, theatrical performances or screenplays, and other short-term needs. Most hair wefts cover a limited area of the scalp: multiple wefts may be required to create a uniform and/or otherwise desired appearance.

Different methods may be used to attach a hair weft to one's pre-existing hair. In some instances, a special glue can be used to bond hair weft to pre-existing hair. These glues, however, generally contain ingredients such as latex, rubber and black hair dye, which are known to cause contact dermatitis, allergic reactions and/or hair loss in some users. Glues are also not desirable because they are difficult to remove, requiring a multistep process using various glue removers (one for hair and one for skin), shampoos and anti-perspirants.

In some instances, hair wefts can be sewn or braided into preexisting hair. In other instances, pre-existing hair can be sewn or braided within a netting cap and the hair wefts can be sewn or braided on the external surface netting cap. In both instances, placement and removal of the hair wefts can be a time consuming and labor intensive. Additionally, when netting caps are used, the user can experience itchiness, accumulation of dandruff and/or oil, difficulty shampooing/conditioning the pre-existing hair contained within the cap, and/or discomfort related to errors in the sewing/braiding process.

In some instances, hair wefts can be applied/installed to pre-existing hair using a solid adhesive, which can be in the form of a double-sided tape. Such hair wefts can be referred to as tape-in hair wefts, tape hair wefts, tape-in extensions or tape extensions. The adhesive is usually medical grade and water proof. Generally, hair wefts are sold with the adhesive already attached. In some instances, hair wefts and the adhesive can be purchased separately and combined prior to installation on the pre-existing hair of a user. When compared to gluing or sewing/braiding, the use of solid adhesives can result in far simpler hair weft installation onto pre-existing hair. Solid adhesives used with hair wefts, however are only effective for a short duration of time, generally 2-8 weeks. After this period, the hair wefts are removed from the hair and, optionally, prepared for re-installation. To remove the solid adhesive from pre-existing hair, oil- or alcohol-based agents are typically applied to the interface of the adhesive and pre-existing hair to dissolve, degrade or otherwise weaken the adhesive. The hair weft is then peeled off the pre-existing hair and the dissolved or weakened adhesive is removed from the hair weft. After removal of the dissolved or weakened adhesive is removed, the hair weft is cleaned to remove any remaining oil- or alcohol-based agents and a new solid adhesive is applied to the hair weft. Thereafter, the hair weft is re-installed on the user's hair.

DETAILED DESCRIPTION

Figure 1:
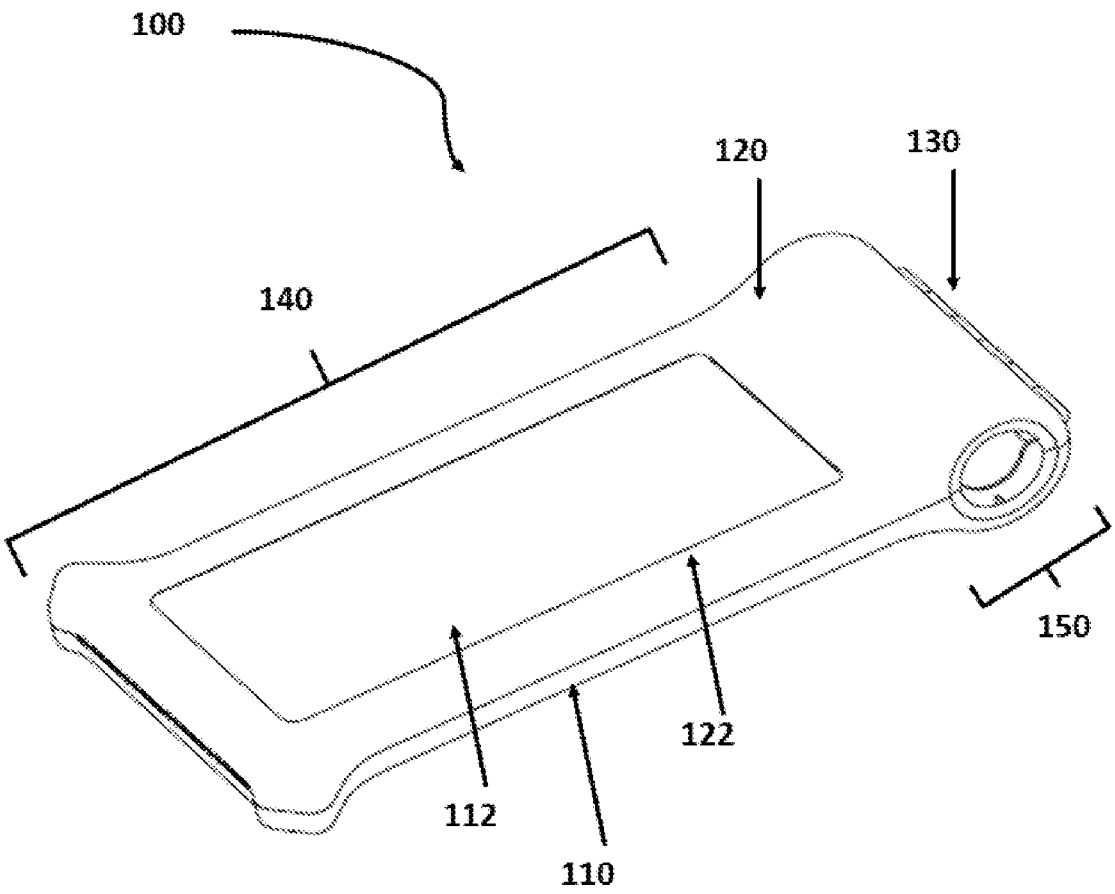
FIG. 1 is a perspective view of a tool for the removal of an adhesive from a hair weft, in accordance with various aspects of the present disclosure, in a closed configuration.

The following description of the embodiments is merely exemplary in nature and is in no way intended to limit the subject matter of the present disclosure, their application, or uses.

As used throughout, ranges are used as shorthand for describing each and every value that is within the range. Any value within the range can be selected as the terminus of the range.

For the purposes of this specification and appended claims, unless otherwise indicated, all numbers expressing quantities, percentages or proportions, and other numerical values used in the specification and claims, are to be understood as being modified in all instances by the term "about." The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent, alternatively ±5 percent, and alternatively ±1 percent of the given numeric value provided such a deviation does not alter the end function or result of the value. Accordingly, unless indicated to the contrary, the numerical parameters set forth in this specification and attached claims are approximations that can vary depending upon the desired properties sought to be obtained by the present invention.

It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. For example, as used in this specification and the following claims, the terms "comprise" (as well as forms, derivatives, or variations thereof, such as "comprising" and "comprises"), "include" (as well as forms, derivatives, or variations thereof, such as "including" and "includes") and "has" (as well as forms, derivatives, or variations thereof, such as "having" and "have") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

For the purposes of this specification and appended claims, the term "coupled" refers to the linking or connection of two objects. The coupling can be permanent or reversible. The coupling can be direct or indirect. An indirect coupling includes connecting two objects through one or more intermediary objects. The term "substantially" refers to an element essentially conforming to the particular dimension, shape or other word that substantially modifies, such that the component need not be exact. For example, substantially rectangular means that the object resembles a rectangle, but can have one or more deviations from a true rectangle.

The present disclosure is directed to a tool which facilitates the recycling and reuse of tape-in (solid adhesive) hair wefts. As discussed above, hair wefts can be applied to pre-existing hair using a solid adhesive. The adhesive can generally be in the form of a two-sided tape or strip. The adhesive is usually medical grade and water proof. Generally, hair wefts are sold with the adhesive already attached. In some instances, hair wefts and solid adhesive can be purchased separately and combined prior to installation on the pre-existing hair of a user. When compared to other hair wefts, ones installed using solid adhesives are far cheaper, simpler and faster to install. Tape-in hair wefts, however, are only effective for a short duration of time (generally 2-8 weeks) because the adhesiveness of the adhesive diminishes over time. After this period, the hair wefts must be removed from the hair and prepared for re-installation. To remove the solid adhesive from pre-existing hair, oil- or alcohol-based agents are typically applied to the adhesive and pre-existing hair to dissolve, degrade or otherwise weaken the adhesive. The hair weft is then peeled off the pre-existing hair and the old adhesive is removed from the hair weft. After the old adhesive is removed, a new solid adhesive (such as a two-sided adhesive tape) is applied to the hair weft and the hair weft is re-installed on the user's hair. Previously, the dissolved or weakened adhesive was removed using either one's finger or a general workplace surface. A tool in accordance with the present disclosure, provides an ergonomic, space efficient and aesthetically pleasing means for removing dissolved or weakened adhesive from a hair weft prior to application of a new solid adhesive to the hair weft for re-application on a user's hair.

Figure 2:
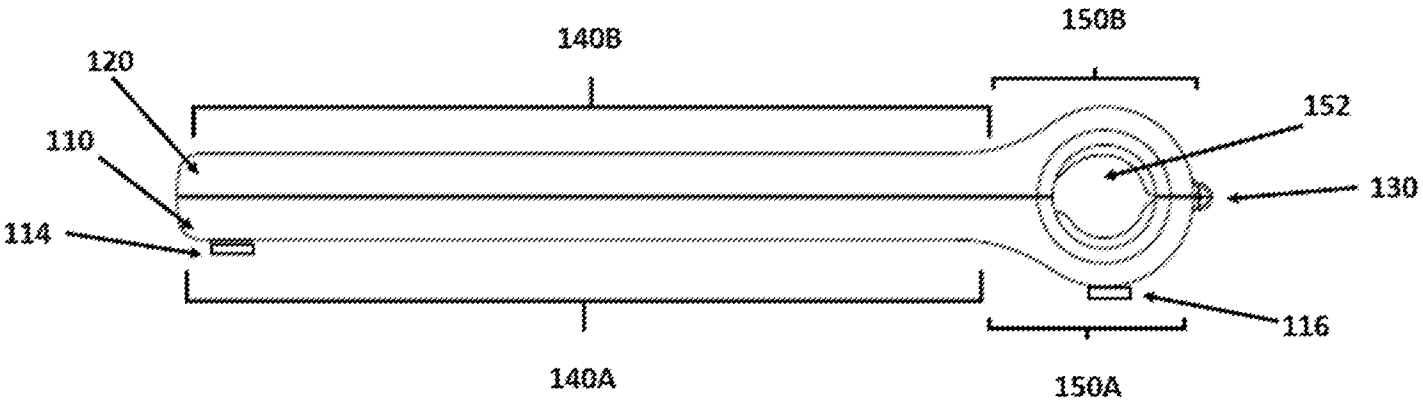
FIG. 2 is a right side elevational view of the tool of FIG. 1, in accordance with various aspects of the present disclosure, in a closed configuration.

FIG. 1 is a perspective view of a tool 100 for the removal of an adhesive from a hair weft, in accordance with various aspects of the present disclosure, in a closed configuration. FIG. 2 is a right side elevational view of the tool 100. The tool 100 includes a base 110 and a partial covering 120 coupled via a pivotable hinge 130. In some instances, the pivotable hinge 130 can include a spring assembly configured to bias the partial covering 120 away from the base 110 such that the partial covering 120 and the base 110 are in an open position unless the partial covering 120 is forced toward the base 110. In some instances, the pivotable hinge 130 can include a spring assembly configured to bias the partial covering 120 toward the base 110 such that the partial covering 120 and the base 110 are in a closed position unless the partial covering 120 is forced away from the base 110. The partial covering 120 includes an aperture 122 which allows for access to an interior surface 112 of the base 110.

The tool 100 can be generally described as rectangular (having a length and a width) and as having regions 140 and 150. In region 140, the base 110 (region 140A) and partial covering 120 (region 140B) are configured to touch when the tool 100 is in a closed configuration. In region 150, the base 110 (region 150A) and partial covering 120 (region 150B) are configured to form an aperture 152 running through the width of region 150 when the tool 100 is in a closed configuration. The aperture 122 of the partial covering 120 and the interior surface 112 of the base 110 is located in region 140. The base 110 can further include elements 114 and 116 designed to prevent the movement of the tool 100 along a surface upon which it may be located during use. In some instances, elements 114 and 116 are rubber stoppers or pads.

Figure 3:
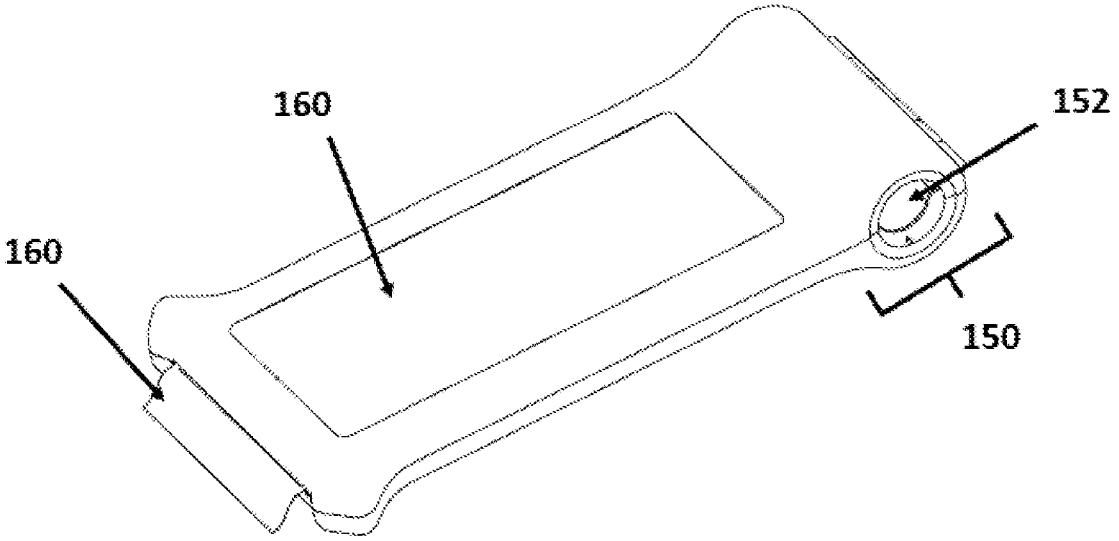
FIG. 3 is a perspective view of the tool of FIG. 1, in accordance with various aspects of the present disclosure, in a closed configuration with a roll of a disposable fabric incorporated therein.

FIG. 3 is a perspective view of the tool 100 of FIG. 1, in a closed configuration with a roll 162 (FIGS. 6-7) of a disposable or recyclable fabric 160 incorporated therein. The roll 162 of disposable or recyclable fabric 160 is contained within the aperture 152 of region 150. Fabric 160 from the roll 162 can be extended through region 140A of the base 110 and region 140B of the partial covering 120, between the base 110 and partial covering 120. A user can interact with the fabric 160 through aperture 122 of the partial covering 120 and the fabric 160 can rest upon the interior surface 112 of the base 110. The interior surface 112 can be made of a material which prevents movement of the fabric 160 when the fabric 160 is located on the interior surface 112. In some instances, the interior surface 112 is made of a rubber. In other instances, the interior surface 112 can be made of a wood, a metal, a carbon fiber, or any other suitable material. The base 110 and partial covering 120 can further include grooves 154 and 156 (FIG. 4) facing toward an inner portion of the aperture 152 designed to prevent side-to-side movement of the roll 162 of fabric 160 within the aperture 152.

In some instances, the fabric 160 can be a paper product such as base paper, bond paper, construction paper, cotton fiber paper, cover paper, brown, white or woven envelope paper, form bond paper, kraft bag paper, kraft wrapping paper, mechanical paper, newsprint paper, packaging paper, fine paper, recycled paper, specialty industrial paper, text paper, wax paper, sand paper, or sanitary paper. In some instances, the fabric 160 can be a natural or synthetic woven or non-woven fibrous material such as gauze, cotton, polyester, nylon, nitrocellulose (Rayon), bamboo fabric, jute, flax, hemp, sisal, ramie, and wool. In some instances, the fabric 160 can be a foil such as aluminum foil.

In some instances, the fabric 160 is textured to provide a roughened surface to enhance the efficiency of the transfer of the adhesive from the hair weft to the fabric 160. In some instances, the fabric 160 can have a textured surface in the form of regular (that is, repeating) or irregular pattern. In some instances, the fabric 160 can have a textured surface in the form of pleats. In some instances, the fabric 160 can have a textured surface in the form of bumps, nubs, protrusions, or the like. In some instances, the fabric 160 can have a textured surface in the form of parallel or intersecting striations.

Figure 4:
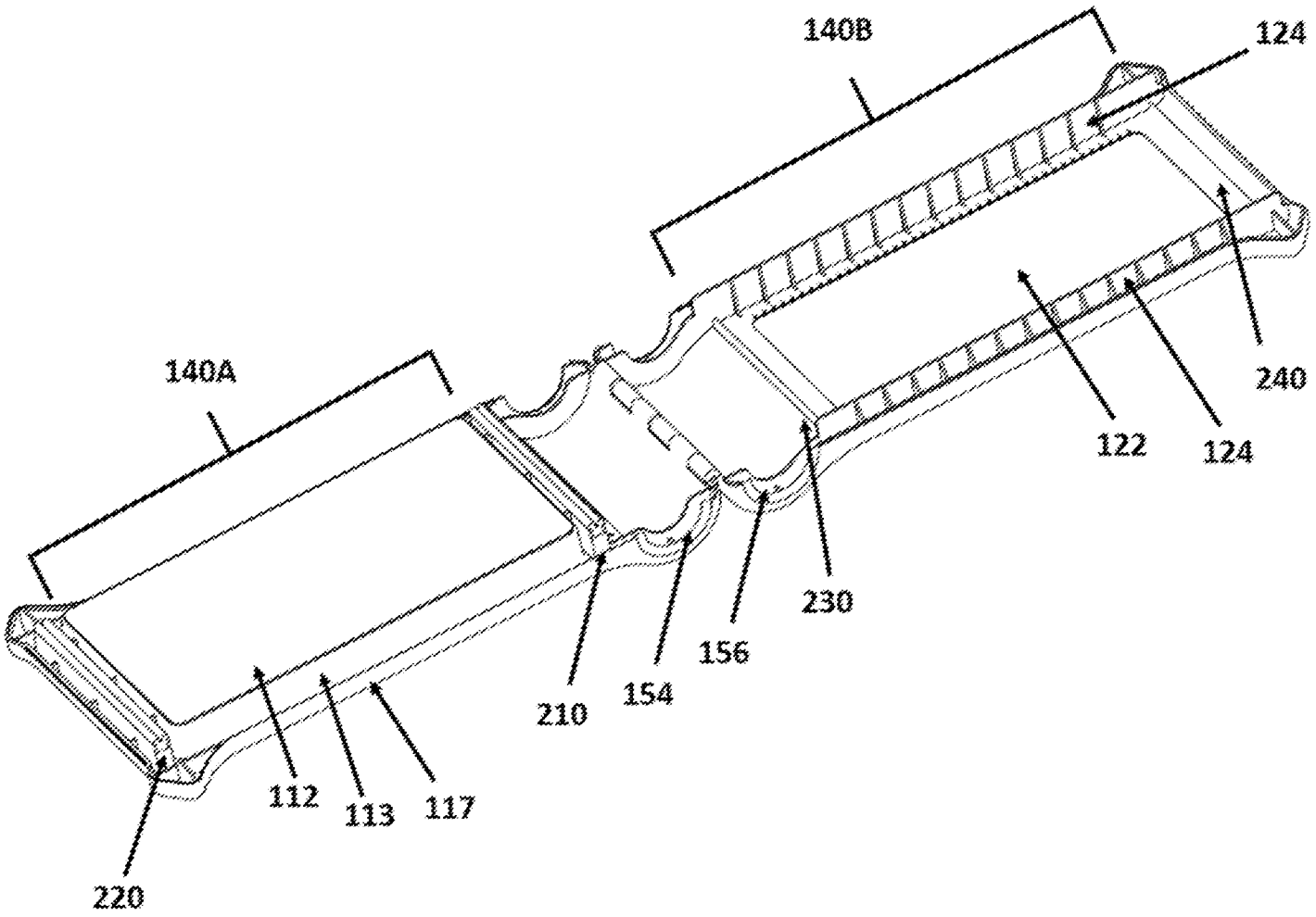
FIG. 4 is a perspective view of a tool of FIG. 1, in accordance with various aspects of the present disclosure, in an open configuration.
Figure 5:
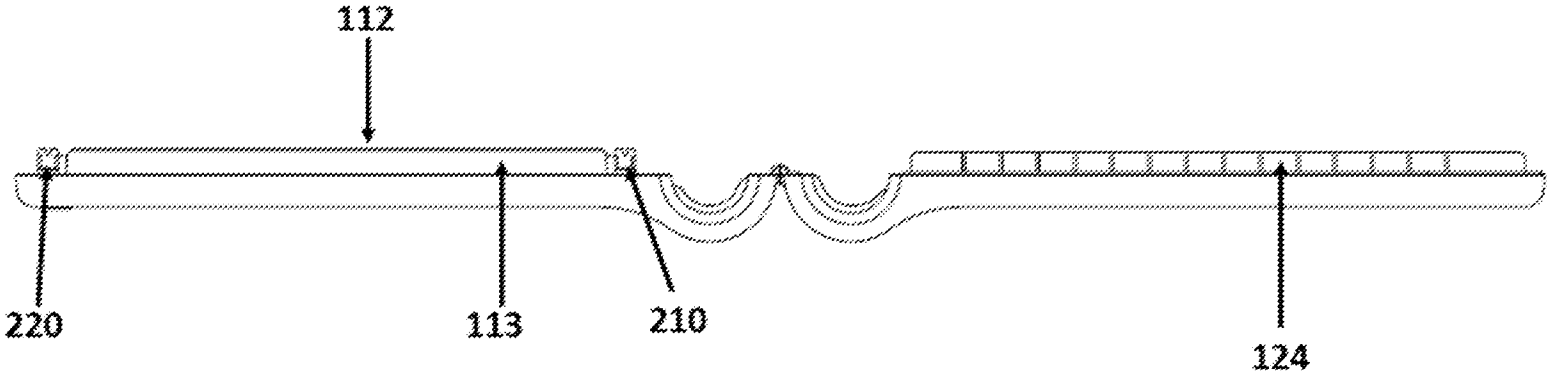
FIG. 5 is a right side elevational view of the tool of FIG. 1, in accordance with various aspects of the present disclosure, in an open configuration.

FIG. 4 is a perspective view of a tool of FIG. 1, in accordance with various aspects of the present disclosure, in an open configuration. FIG. 5 is a right side elevational view of the tool of FIG. 1, in accordance with various aspects of the present disclosure, in an open configuration. As further illustrated in FIGS. 4 and 5, the interior surface 112 of the base 110 is supported by a stage 113. An external shell 117 of the base 110 and the stage 113 are separated from each other by a recess or gap. The recess or gap extends longitudinally along region 140A of the base 110 on each longitudinal side of the base. The base 110 also include grooved members 210 and 220 adjacent to and on opposite ends of the stage 113, running along the width of region 140A and terminating at the first and second recesses or gaps. The grooved members 210, 220 extend vertically such that their top surfaces are either planar with or slightly above the interior surface 112. An internal surface of the partial covering 120 includes protrusions 124 extending longitudinally along region 140B of the partial covering 120. An internal surface of the partial covering 120 also includes protruding members 230 and 240 running along the width of region 140B and terminating at the protrusions 124. Each protrusion 124 is designed to conformance fit within the corresponding recess or gap between the base 110 and the stage 113 when the tool 100 is in a closed configuration (FIGS. 1 and 2). The protruding members 230 and 240 are designed to conformance fit within the grooved members 210 and 220 when the tool 100 is in a closed configuration (FIGS. 1-2 and 8-9).

Figure 6:
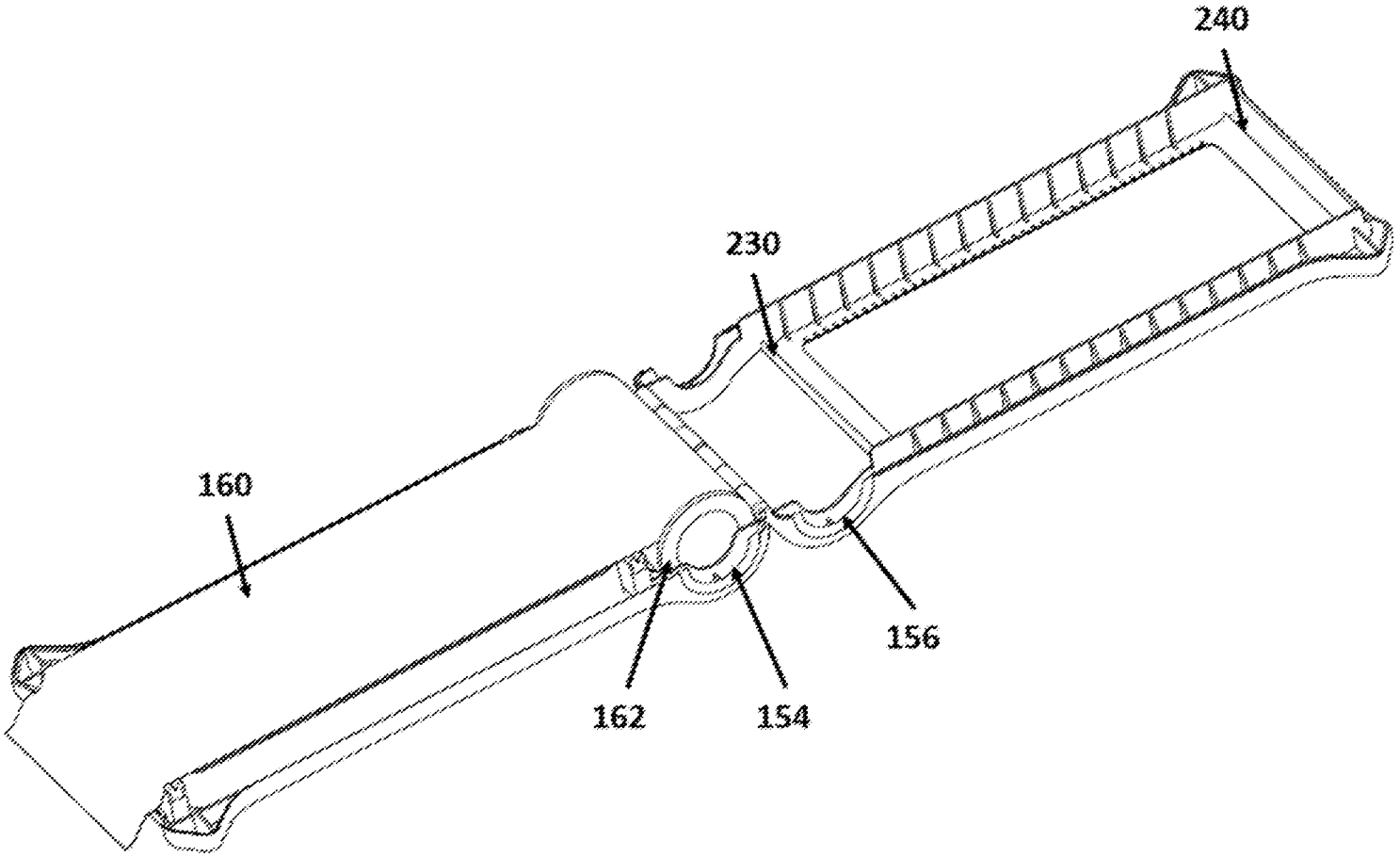
FIG. 6 is a perspective view of the tool of FIG. 1, in accordance with various aspects of the present disclosure, in an open configuration with a roll of a disposable fabric incorporated therein.
Figure 7:
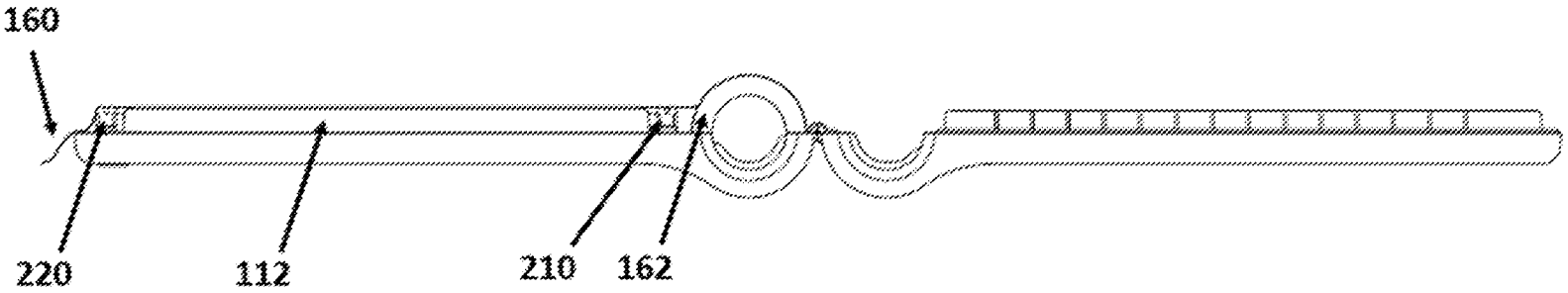
FIG. 7 is a right side elevational view of the tool of FIG. 1, in accordance with various aspects of the present disclosure, in an open configuration with a roll of a disposable fabric incorporated therein.

FIG. 6 is a perspective view of the tool 100 of FIG. 1, in accordance with various aspects of the present disclosure, in an open configuration with a roll 162 of a fabric 160 incorporated therein. FIG. 7 is a right side elevational view of the tool 100 of FIG. 1, in accordance with various aspects of the present disclosure, in an open configuration with a roll 162 of a fabric. When the tool 100 is in an open configuration, the roll 162 rests within region 150A of the base 110 and grooves 154 prevent side-to side movement of the roll 162. The fabric 160 from the roll 162 can be extended to lay on the interior surface 112 and the grooved members 210 and 220. When the tool 100 is in a closed configuration (FIG. 3) grooves 154 and 156 prevent side-to side movement of the roll 162 within the aperture 152. When the tool 100 is in a closed configuration (FIG. 3), protrusions 124 prevent side-to side movement of the fabric 160 within region 140 of the tool 100. Also, when the tool 100 is in a closed configuration (FIG. 3), the combination of protruding members 230 and 240 and grooved members 210 and 220 prevent longitudinal movement of the fabric 160 (that is, movement toward and away from the roll 162) within region 140 of the tool 100.

Figure 8:
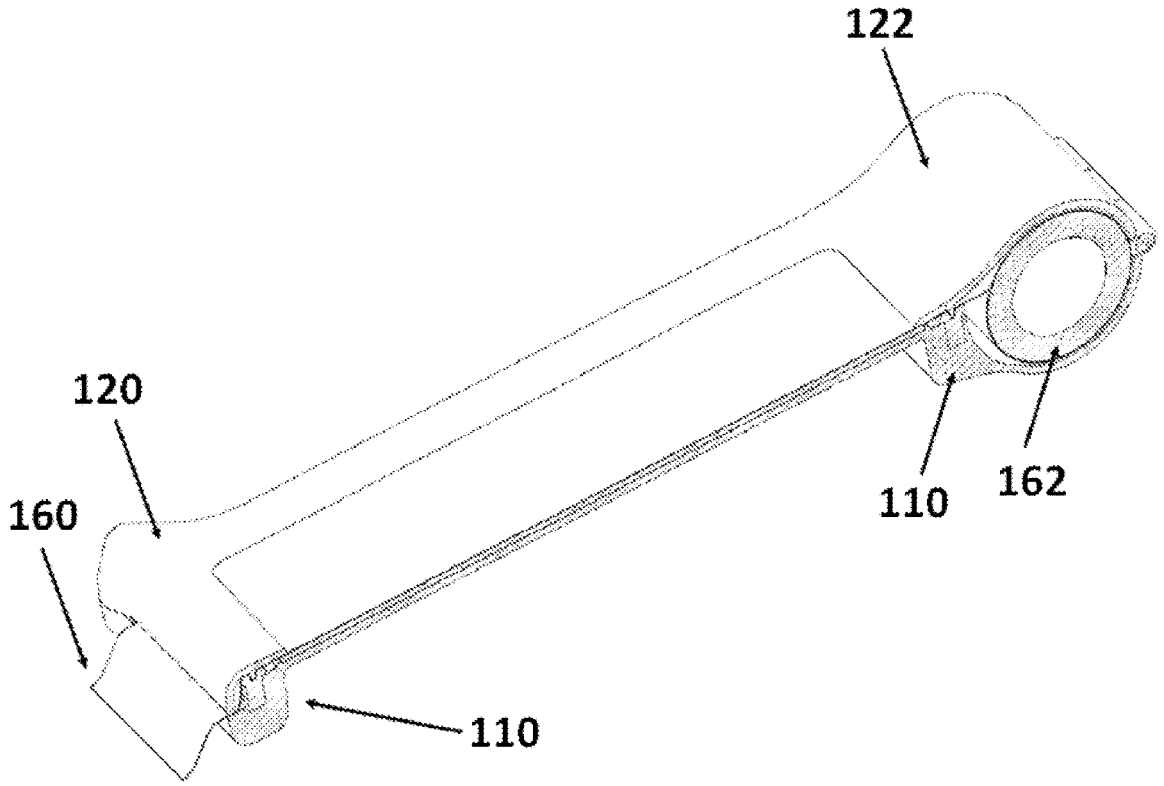
FIG. 8 is a cross-sectional perspective view of the tool of FIG. 1, in accordance with various aspects of the present disclosure, in a closed configuration with a roll of a disposable fabric incorporated therein.
Figure 9:
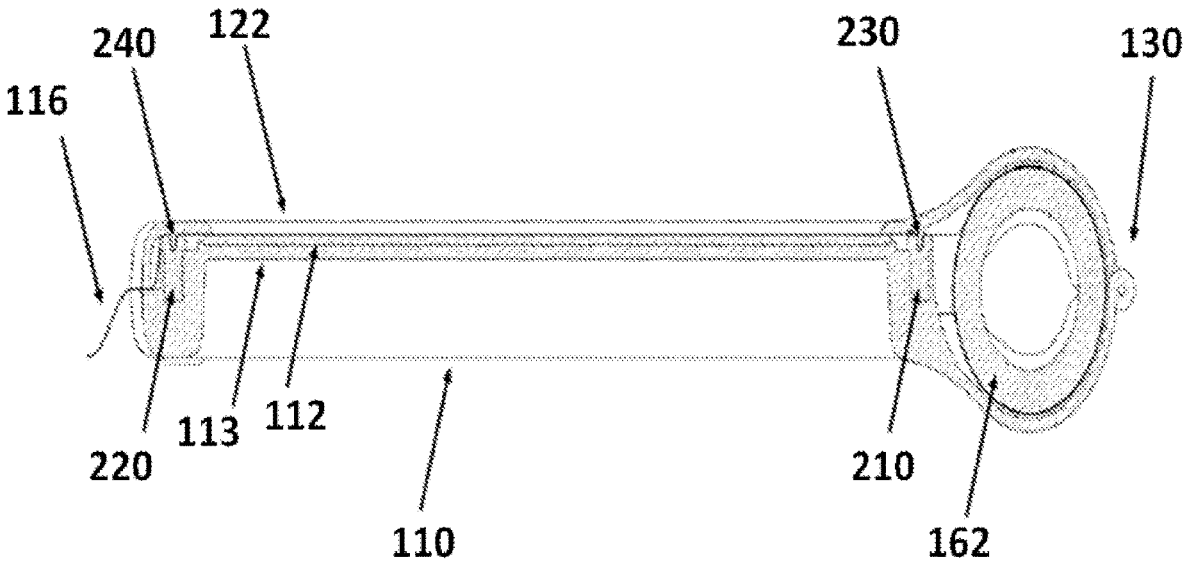
FIG. 9 is a cross-sectional right side elevational view of the tool of FIG. 1, in accordance with various aspects of the present disclosure, in a closed configuration with a roll of a disposable fabric incorporated therein.

FIG. 8 is a cross-sectional perspective view of the tool of FIG. 1, in accordance with various aspects of the present disclosure, in a closed configuration with a roll 162 of fabric 160 incorporated therein. FIG. 9 is a cross-sectional right side elevational view of the tool of FIG. 1, in accordance with various aspects of the present disclosure, in a closed configuration with a roll 162 of fabric 160 incorporated therein. As shown, when the tool 100 is in a closed configuration the fabric 160 lays upon the interior surface 112 and is held in placed by protruding members 230 and 240 and grooved members 210 and 220 prevent longitudinal movement of the fabric 160 within region 140 of the tool 100.

As shown in FIGS. 1-9, the tool 100, from a top plan view, is substantially rectangular in shape. In some instances, the tool 100 can have a length of about 8 to about 12 inches and a width of about 5 to about 8 inches, and the aperture 122 and interior surface 112 can have lengths of about 6 to about 10 inches and widths of about 3 to about 5 inches. These dimensions are, however, in no way limiting. In some instances, the tool 100, from a top plan view, can be substantially square, circular, semi-circular, ovoidal, semi-ovoidal, triangular, trapezoidal, pentagonal, hexagonal, heart-shaped, ellipsoidal, semi-ellipsoidal, curvilinear, triangular, or any other ergonomically and/or aesthetically suitable shape.

Figure 10:
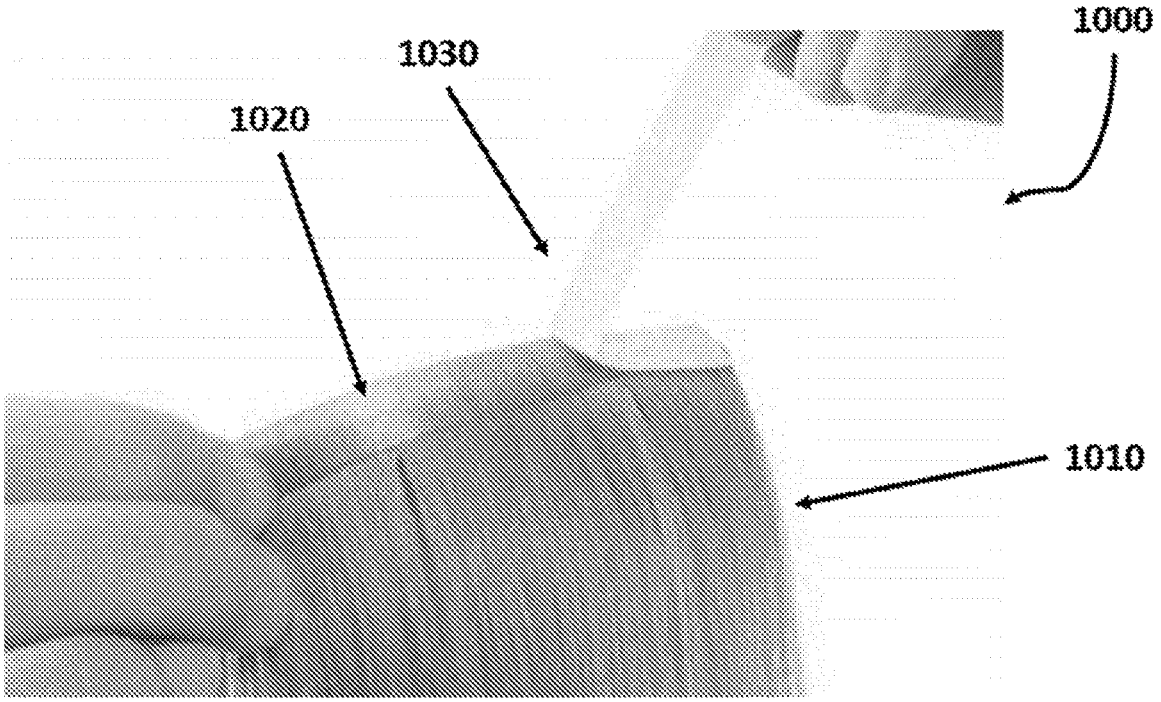
FIG. 10 is an image of a portion of a tape-in hair weft.
Figure 11:
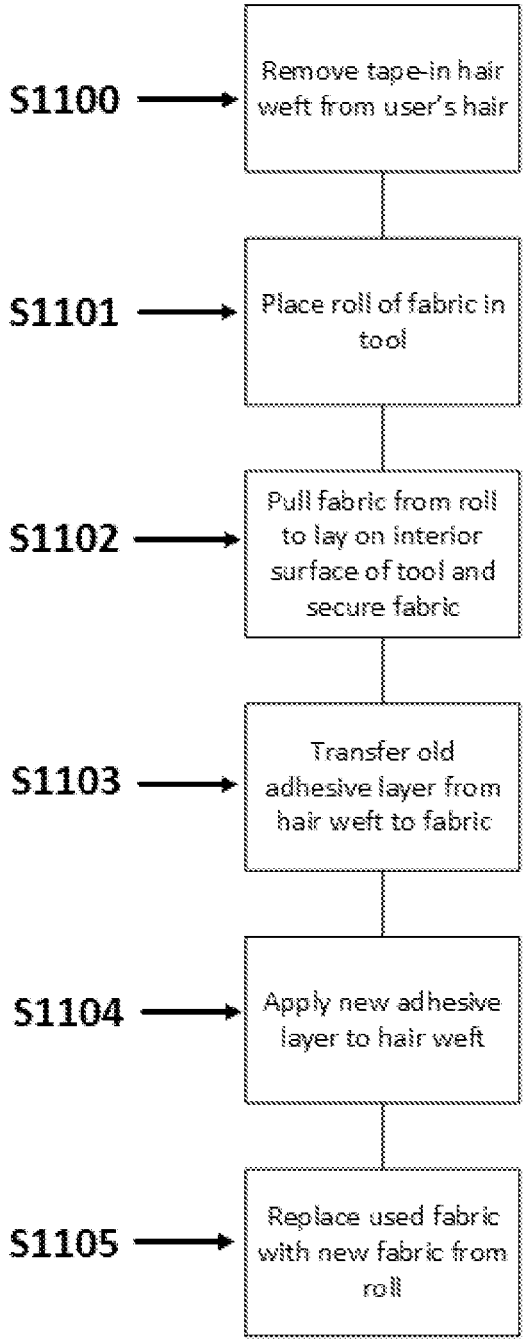
FIG. 11 is a flowchart of an exemplary method for using a tool for the removal of an adhesive from a hair weft, in accordance with various aspects of the present disclosure.

FIG. 10 shows a portion of a tape-in hair weft 1000. The hair weft 1000 includes a plurality strands of natural or synthetic hair 1010, and an adhesive layer 1020 adhered to a terminus of each strand of hair of the plurality strands of natural or synthetic hair 1010. A protective layer 1030 is located on a surface of the adhesive layer 1020, opposite the plurality strands of natural or synthetic hair 1010, and is removed prior to installation in a user's hair. As discussed above, the adhesive strength of the adhesive layer 1020 diminishes over time (generally 2-8 weeks). For reuse of the hair weft, the old adhesive layer 1020 must be removed from the plurality of strands of natural or synthetic hair 1010 and a new adhesive layer must be applied. FIG. 11 is a flowchart of an exemplary method of using the tool 100, or a variation thereof, for the removal of the old adhesive layer 1020 from a tape-in hair weft. While the method shown in FIG. 11 contains a number of steps, one or more steps may be added to or excluded from the method or the steps can be performed in the same order or a modified order, without departing from the scope of the method. The method can start at S1100.

In S1100, a tape-in hair weft is removed from a user's hair. The tape-in hair weft 1000 can be properly removed by applying one or more oil- or alcohol-based agents to the user's hair and the adhesive layer 1020 of the tape-in hair weft, to at least partially dissolve, degrade or otherwise weaken the adhesive layer 1020. The hair weft 1000 is then removed (for example, peeled) from the user's hair.

In S1101, a roll 162 of a fabric 160 is placed in the tool 100 while the tool 100 is in an open configuration.

In S1102, the fabric 160 is pulled from the roll 162 to extend across the grooved members 210 and 220 and interior surface 112. The tool 100 is then transitioned from the open configuration to a closed configuration such that movement of the fabric 160 is prevented by a combination of the protrusions 124, the protruding members 230 and 240, and the grooved members 210 and 220.

In S1103, a user grips the plurality of strands of natural or synthetic hair 1010, near the weakened old adhesive layer 1020, and contacts the old adhesive layer 1020 to the fabric 160 through the aperture 122 of the partial covering 120. The contact is performed with an amount of pressure and a degree of movement (along the surface of the fabric 160) sufficient to transfer the weakened old adhesive layer 1020 from the hair weft 1000 to the fabric 160. The movement can be a rubbing, dragging, scraping, spotting, a linear motion, a circular motion, or any other movement suitable to transfer the weakened old adhesive layer 1020 from the hair weft 1000 to the fabric 160.

In S1104, a new adhesive layer is placed on the hair weft 1000 in the same location, or substantially the same location, previously occupied by the weakened old adhesive layer 1020.

In S1105, the tool 100 is transitioned from the closed to configuration to an open or partially open configuration. The used fabric 160 is pulled from the tool 100 and new fabric 160, from the roll 162, is set across the grooved members 210 and 220 and interior surface 112. The tool 100 is transitioned from the open or partially open configuration to a closed configuration for subsequent use.

STATEMENTS OF THE DISCLOSURE

Statements of the disclosure include: To be completed with claims.

Statement 1: A tool for removing an adhesive from a hair weft, the tool comprising: a base portion, the base portion comprising a first region having an interior surface, and a second region: a partial covering portion, the partial covering portion comprising a first region having an access aperture exposing the interior surface of the base portion, and a second region: a pivotable hinge coupling the base portion and the partial covering portion and configured to allow the base portion and the partial covering to bias relative to each other; and a containment aperture configured to hold a roll of a fabric therein, the aperture at least partially bounded by the second region of the base portion and the second region of the partial covering portion.

Statement 2: A tool according to Statement 1, wherein the tool is substantially rectangular, square, circular, semi-circular, ovoidal, semi-ovoidal, triangular, trapezoidal, pentagonal, hexagonal, heart-shaped, ellipsoidal, semi-ellipsoidal, curvilinear, or triangular in shape.

Statement 3: A tool according to Statement 1 or 2, wherein the tool is substantially rectangular in shape.

Statement 4: A tool according to any one of Statements 1-3, further comprising a roll of a fabric contained within the containment aperture.

Statement 5: A tool according to Statement 5, wherein the fabric is any one of a paper product, a natural woven fibrous material, a synthetic woven fibrous material, a natural non-woven fibrous material, a synthetic non-woven fibrous material, a foil, an any combination thereof.

Statement 6: A tool according to Statement 5 or 6, wherein the fabric has a textured surface.

Statement 7: A tool according to any one of Statements 4-6, wherein the fabric is a recyclable fabric.

Statement 8: A tool according to any one of Statements 1-7, wherein the interior surface of the second region of the base portion comprises one or more grooves configured to prevent a movement of the roll of the fabric.

Statement 9: A tool according to any one of Statements 1-8, wherein the interior surface of the second region of the partial covering portion comprises one or more grooves configured to prevent a movement of the roll of the fabric.

Statement 10: A tool according to any one of Statements 1-9, wherein the base portion further comprises a first grooved member located adjacent to a first end of the interior surface near the second region, and a second grooved member located adjacent to a second end of the interior surface, the second end being opposite the first end; and the partial covering portion comprises a first protruding member configured to conformance fit at least partially within the first grooved member, and a second protruding member configured to conformance fit at least partially within the second grooved member.

Statement 11: A tool according to Statement 10, wherein the base portion further comprises a first recess located adjacent to a third end of the interior surface, and a second recess located adjacent to a fourth end of the interior surface, the fourth end being opposite the third end: and the partial covering portion comprises a first protrusion configured to conformance fit at least partially within the first recess, and a second protrusion configured to conformance fit at least partially within the second recess.

Statement 12: A tool according to any one of Statements 1-11, wherein the pivotable hinge allows the base portion and partial covering portion to bias relative to each other to transition the tool between an open configuration and a closed configuration.

Statement 13: A tool according to Statement 12, wherein the pivotable hinge comprises a spring assembly.

Statement 14: A tool according to Statement 13, wherein the spring assembly biases the base portion and partial covering portion to the closed configuration.

Statement 15: A tool according to Statement 13, wherein the spring assembly biases the base portion and partial covering portion to the open configuration.

Statement 16: A tool according to any one of Statements 1-15, wherein the interior surface is made of any one of a rubber, a wood, a metal, and a carbon fiber.

Statement 17: A tool according to any one of Statements 1-16, wherein the interior surface is made a rubber.

Statement 18: A tool according to any one of Statements 1-17, wherein the interior surface is located on a stage that is elevated relative to a bottom surface of the base portion.

Statement 19: A tool for removing an adhesive from a hair weft, the tool comprising a base portion, the base portion comprising an interior surface: a partial covering portion, the partial covering portion comprising an access aperture exposing the interior surface of the base portion: a first region comprising the interior surface of the base portion and the access aperture of the partial covering portion: a second region adjacent to the first region, the second region comprising a containment aperture configured to hold a roll of a fabric therein, and at least partially bounded by a portion of the base portion and a portion of the partial covering portion; and a pivotable hinge located at an end of the second region, the pivotable hinge coupling the base portion and the partial covering portion and configured to allow the base portion and the partial covering to bias relative to each other between an open configuration and a closed configuration.

Statement 20: A tool according to Statement 19, further comprising a roll of a fabric contained within the containment aperture.

Although the present invention and its objects, features and advantages have been described in detail, other embodiments are encompassed by the invention. Finally, those skilled in the art should appreciate that they can readily use the disclosed conception and specific embodiments as a basis for designing or modifying other structures for carrying out the same purposes of the present invention without departing from the scope of the invention as defined by the appended claims.

What is claimed is:

1. A tool for removing an adhesive from a hair weft, the tool comprising:

a base portion, the base portion comprising:

a first region having an interior surface; and a second region;

a partial covering portion, the partial covering portion comprising:

a first region having an access aperture exposing the interior surface of the base portion to an external environment; and a second region;

a pivotable hinge coupling the base portion with the partial covering portion and configured to allow the base portion and the partial covering portion to bias relative to each other; and a containment aperture holding a roll of a fabric therein, wherein the containment aperture is at least partially bounded by the second region of the base portion and the second region of the partial covering portion and an interior surface of the second region of the base portion and an interior surface of the second region of the partial covering portion face the roll of the fabric, wherein the tool is configured to allow the fabric from the roll to extend from the containment aperture to cover the interior surface and, when the fabric from the roll is extended to cover the interior surface, the fabric rests upon the interior surface of the first region of the base portion and the fabric resting upon the interior surface is engageable by a user from the external environment via the access aperture of the partial covering portion.

2. The tool of claim 1, wherein the tool is substantially rectangular, square, circular, semi-circular, ovoidal, semi-ovoidal, triangular, trapezoidal, pentagonal, hexagonal, heart-shaped, ellipsoidal, semi-ellipsoidal, curvilinear, or triangular in shape.

3. The tool of claim 1, wherein the tool is substantially rectangular in shape.

4. The tool of claim 1, wherein the fabric is any one of a paper product, a natural woven fibrous material, a synthetic woven fibrous material, a natural non-woven fibrous material, a synthetic non-woven fibrous material, a foil, or any combination thereof.

5. The tool of claim 1, wherein the fabric has a textured surface.

6. The tool of claim 1, wherein the fabric is a recyclable fabric.

7. The tool of claim 1, wherein an interior surface of the second region of the base portion comprises one or more grooves configured to prevent a movement of the roll of the fabric.

8. The tool of claim 1, wherein an interior surface of the second region of the partial covering portion comprises one or more grooves configured to prevent a movement of the roll of the fabric.

9. The tool of claim 1, wherein the base portion further comprises:

a first grooved member located adjacent to a first end of the interior surface near the second region; and a second grooved member located adjacent to a second end of the interior surface, the second end being opposite the first end; and the partial covering portion comprises:

a first protruding member configured to conformance fit at least partially within the first grooved member; and a second protruding member configured to conformance fit at least partially within the second grooved member.

10. The tool of claim 1, wherein the pivotable hinge allows the base portion and the partial covering portion to bias relative to each other to transition the tool between an open configuration and a closed configuration.

11. The tool of claim 10, wherein the pivotable hinge comprises a spring assembly.

12. The tool of claim 11, wherein the spring assembly biases the base portion and the partial covering portion to the closed configuration.

13. The tool of claim 11, wherein the spring assembly biases the base portion and the partial covering portion to the open configuration.

14. The tool of claim 1, wherein the interior surface is made of any one of a rubber, a wood, a metal, and a carbon fiber.

15. The tool of claim 1, wherein the interior surface is made of a rubber.

16. The tool of claim 1, wherein the interior surface is located on a stage that is elevated relative to a bottom surface of the base portion.

17. A tool for removing an adhesive from a hair weft, the tool comprising:

a base portion, the base portion comprising an interior surface;

a partial covering portion, the partial covering portion comprising an access aperture exposing the interior surface of the base portion to the external environment;

a first region comprising the interior surface of the base portion and the access aperture of the partial covering portion;

a second region adjacent to the first region, the second region comprising a containment aperture holding a roll of a fabric therein, and at least partially bounded by a portion of the base portion and a portion of the partial covering portion; and a pivotable hinge located at an end of the second region, the pivotable hinge coupling the base portion and the partial covering portion and configured to allow the base portion and the partial covering portion to bias relative to each other between an open configuration and a closed configuration, wherein the tool is configured to allow fabric from the roll to extend from the containment aperture to cover the interior surface and, when fabric from the roll is extended to cover the interior surface, the fabric rests upon the interior surface of the base portion and the fabric resting upon the interior surface is engageable by a user from the external environment via the access aperture of the partial covering portion when in the closed configuration.

18. The tool of claim 1, wherein the tool has a length ranging from about 8 inches to about 12 inches and a width ranging about 5 inches to about 8 inches.

19. The tool of claim 18, wherein each of the access aperture and the interior surface have a length ranging from about 6 inches to about 10 inches and a width ranging from about 3 inches to about 5 inches.

* * * * *